United States Patent [19]

Jürgens et al.

[11] Patent Number: 4,610,307

[45] Date of Patent: Sep. 9, 1986

[54] METHOD AND APPARATUS FOR SELECTIVELY STRAIGHT OR DIRECTIONAL DRILLING IN SUBSURFACE ROCK FORMATION

[75] Inventors: Rainer Jürgens, Celle-Osterloh; Volker Krüger, Celle, both of Fed. Rep. of Germany

[73] Assignee: Norton Company, Worcester, Mass.

[21] Appl. No.: 810,895

[22] Filed: Dec. 18, 1985

Related U.S. Application Data

[63] Continuation of Ser. No. 693,343, Jan. 22, 1985, abandoned.

[30] Foreign Application Priority Data

Jan. 31, 1984 [DE] Fed. Rep. of Germany ..... 3403239

[51] Int. Cl.[4] ..... E21B 17/10; E21B 17/20

[52] U.S. Cl. ..... 175/320; 175/325

[58] Field of Search ..... 175/325, 320, 256, 73–76; 166/241, 242; 308/4 R, 4 A

[56] References Cited

U.S. PATENT DOCUMENTS

| | | | |
|---|---|---|---|
| 2,829,864 | 4/1958 | Knapp | 175/76 X |
| 3,135,103 | 6/1964 | Black | 464/20 |
| 3,563,323 | 2/1971 | Edgecombe | 175/76 |
| 3,730,286 | 5/1973 | Weiner | 464/183 X |
| 3,938,853 | 2/1976 | Jurgens et al. | 308/4 A |
| 4,319,649 | 3/1982 | Jeter | 175/73 |
| 4,465,147 | 8/1984 | Feenstra et al. | 175/73 |

*Primary Examiner*—James A. Leppink
*Assistant Examiner*—David J. Bagnell
*Attorney, Agent, or Firm*—Walter Fred

[57] ABSTRACT

A device for use in underground drilling comprising:

a tubular housing, a down-hole motor mounted within the housing and having an output shaft, means for connecting said output shaft to a drill bit, means for connecting said housing to a drill string, first and second stabilizers mounted on said housing, said first stabilizer being mounted nearer than the second stabilizer to the output shaft connecting means, at least one of said stabilizers being an eccentric stabilizer, and at least one stress relieving means between the first stabilizer and the means for connecting the housing to the drill string.

6 Claims, 13 Drawing Figures

METHOD AND APPARATUS FOR SELECTIVELY STRAIGHT OR DIRECTIONAL DRILLING IN SUBSURFACE ROCK FORMATION

RELATED APPLICATIONS

This application is a continuation of application Ser. No. 06/693,343, filed Jan. 22, 1985 now abandoned.

BACKGROUND OF THE INVENTION

This invention relates to devices for use in underground drilling.

European Patent Application No. 0085444, the subject matter of which appears in U.S. Pat. No. 4,465,147, describes a device which is capable of being used for straight drilling or for drilling at an angle. In particular the application describes a method and means for controlling the course of a bore hole during drilling.

The method and means includes first and second stabilisers which are arranged to support the housing for a down-hole motor having an output shaft for connecting to a drill bit. At least one of the stabilisers is eccentric relative to the housing so that rotation of the housing will cause a change in the angle of the axis of the output shaft of the down-hole motor. Thus by controlling the rotation of the housing and the length of time of operation of the down-hole motor the course of the bore-hole can be controlled.

The change in angle causes stresses to be introduced into the housing which are transmitted to the drill bit causing excessive friction between the drill bit and the wall of the bore-hole. Furthermore additional strains are imposed on the stabilisers, the connections between the drill string and the housing, between the down-hole motor output shaft and the drill bit and between sections of the housing. These stresses can lead to damage and/or excessive wear of bearings.

It is an object of the present invention to provide an improved device for use in underground drilling which reduces the stress-related problems identified above.

SUMMARY OF THE INVENTION

According to the present invention we provide a device for use in underground drilling comprising:

- a tubular housing,
- a down-hole motor mounted within the housing and having an output shaft,
- means for connecting said output shaft to a drill bit,
- means for connecting said housing to a drill string,
- first and second stabilisers mounted on said housing,
- said first stabiliser being mounted nearer than the second stabiliser to the output shaft connecting means,
- at least one of said stabilisers being an eccentric stabiliser, and
- at least one stress relieving means between the first stabiliser and the means for connecting the housing to the drill string.

In one embodiment of the invention the stress relieving means comprises a relatively flexible section of said housing means. The relatively flexible property can be achieved by reducing the wall thickness or by making the section of a relatively flexible material.

In an alternative embodiment of the invention the stress relieving means comprises a connection associated with a stabiliser. The connection may be a permanently angled connection in which two components thereof are secured together an at angle or it may comprise a joint which permits relative angular movement between two components thereof.

In a preferred arrangement the first stabiliser is concentric with the housing and the second stabiliser is eccentric with the housing.

Preferably the stress relieving means is situate between the second stabiliser and the drill string connecting means.

Sometimes it is desirable to employ at least two stress relieving means, a first stress relieving means being situate between the concentric and eccentric stabilisers and a second stress relieving means being situate between the eccentric stabiliser and the drill string connecting means.

In some situations a further concentric stabiliser may be located above the eccentric stabiliser and a third stress relieving means included above the eccentric stabiliser.

BRIEF DESCRIPTION OF THE DRAWINGS

Reference is now made to the accompanying drawings, in which.

DESCRIPTION OF THE PREFERRED EMBODIMENT(S)

Figure 1:
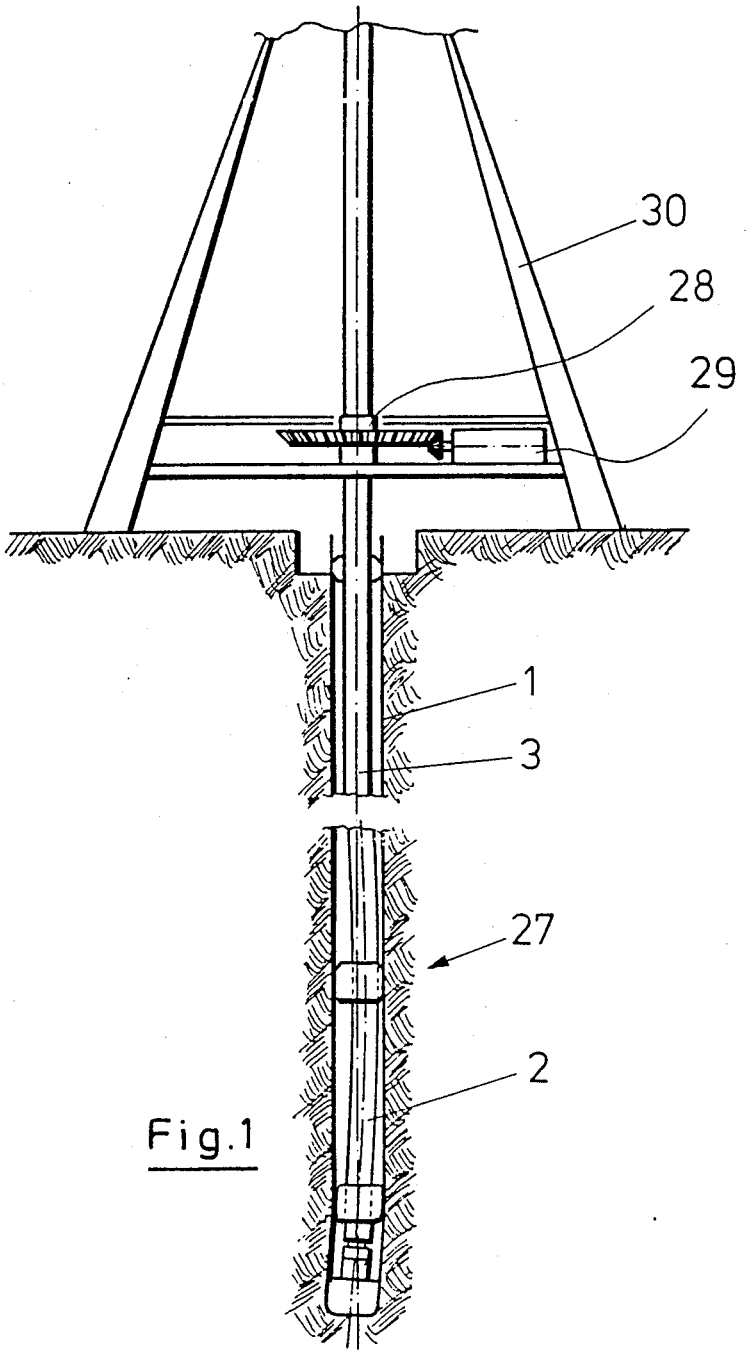
FIG. 1 is a schematic diagram of a drilling device for use in controlled drilling of a bore-hole.
Figure 2:
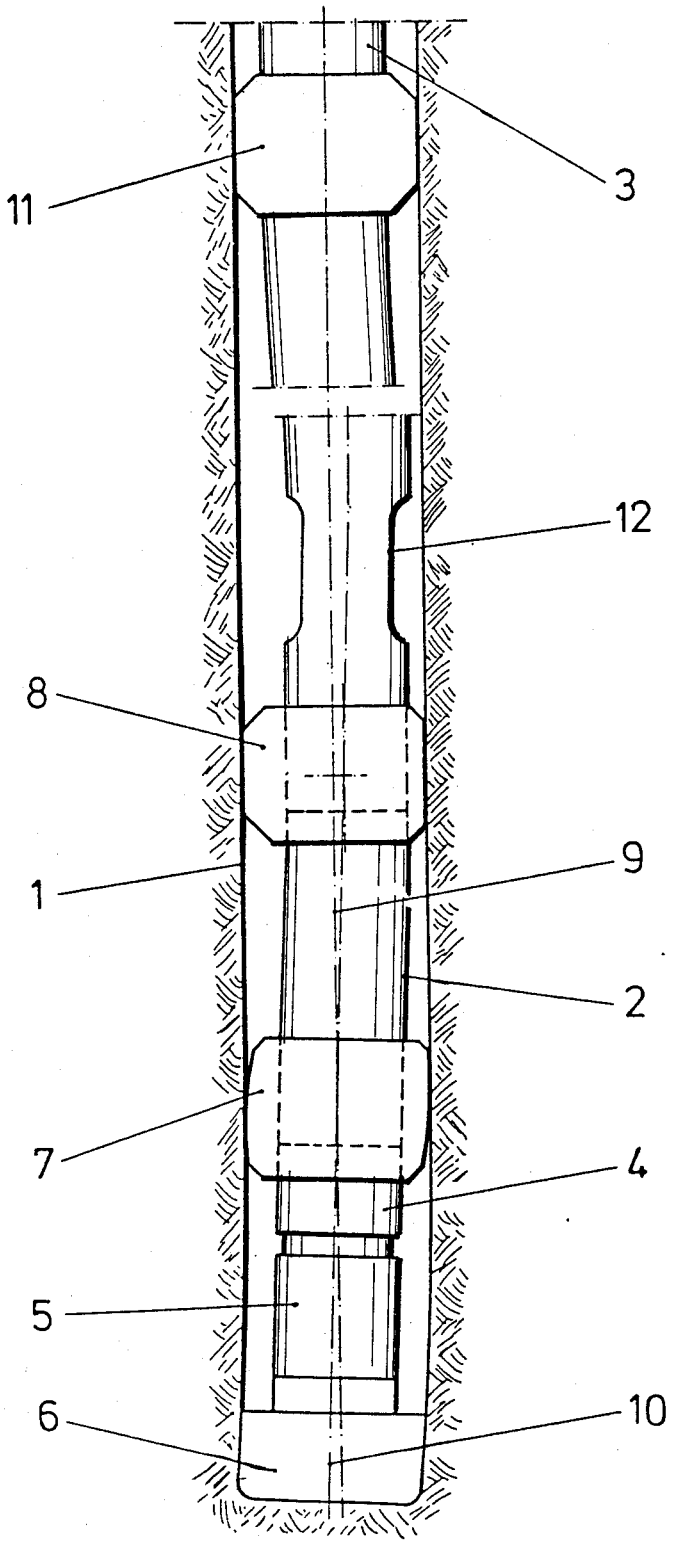
FIGS. 2 to 6 are schematic illustrations of five alternative devices in accordance with the present invention.

The device shown in FIG. 1 incorporates the concepts of European Patent Application No. 0085444 the disclosure of which is included herein by reference. The drilling device 27 is shown in position in a bore-hole 1. It comprises a housing 2 connected to a drill string 3 by means not shown. The connecting means may be a screw threaded arrangement as shown in European Patent Application No. 0085444. The drill string 3 is arranged to be rotated by a turntable 28 having a locking device 29 to prevent rotation of the turntable 28 and drill string 3. The turntable 28 and locking device 29 are mounted on a derrick 30.

The locking device 29 controls the rotation of the drill string 3 to permit, for example, continuous rotation or limited rotation for alignment purposes. When the locking device is in its locking condition it prevents rotation of the drill string 3 and the housing 2.

Various schematic arrangements of drilling devices according to the invention are shown in FIGS. 2 to 7. In each of these figures the drill string 3 is connected to a housing 2, which may be in several sections, a down-hole motor (not shown) and a take-off shaft 5 of the motor in a lower housing section 4, the shaft 5 being connected to a drill bit 6. The connecting means for connecting the take-off shaft 5 to the drill bit 6 may be a screw threaded arrangement as shown in European Application No. 0085444.

The down-hole motor may be positioned as shown in European Patent Application No. 0085444 and may be of any conventional type, for example, a turbine motor, a vane motor, a Moineau-type motor or an electric motor.

In each of the embodiments shown in FIGS. 2 to 7 the housing 2 is mounted in a first stabiliser 7 in which the axis of the stabiliser and the axis of the housing are concentric and a second stabiliser 8 in which the axis of the stabiliser and the axis of the housing are eccentric.

Generally, each stabiliser is provided with peripheral ribs which contact the wall of the bore hole.

As illustrated in FIGS. 2 to 6, the housing 2 is deflected by the second eccentric stabiliser 8 which is constrained by the walls of the bore-hole 1, which moves the axis of the housing from the original bore-hole axis 9, to provide a new axis of rotation 10 of the take-off shaft 5 angled with respect to the original bore-hole axis 9.

The first concentric stabiliser 7 preferably has a rounded periphery in order to prevent its ribs (not shown in FIGS. 2 to 6) from moving out of contact with the bore-hole wall as the housing 2 adopts an increasingly inclined position.

Above the housing 2 a third concentric stabiliser 11 is shown, the size and position of which can be chosen to improve the straight drilling characteristics of the drilling tool 27 in an inclined bore-hole 1.

Several possibilities exist with regard to the arrangement of the second eccentric stabiliser 8. In the embodiment shown in FIG. 2, the second stabiliser 8 is arranged in an upper area of the housing 2. It is also possible to attach it above the housing 2, but this causes the inclination of the axis of rotation 10 with respect to the original drill hole axis 9 to become very small for a given eccentricity of the second stabiliser 8.

The bending, resulting from the inclination of the housing 2 in the bore hole 1 is concentrated on a relatively flexible section 12 which is inserted between the second stabiliser 8 and the drill string 3. Restricting the bending to this section 12 keeps bending stresses, which would otherwise be uniformly distributed over the drill string 3 and the housing 2, away from areas susceptible to wear and damage, such as threaded connections and bearings.

Figure 3:
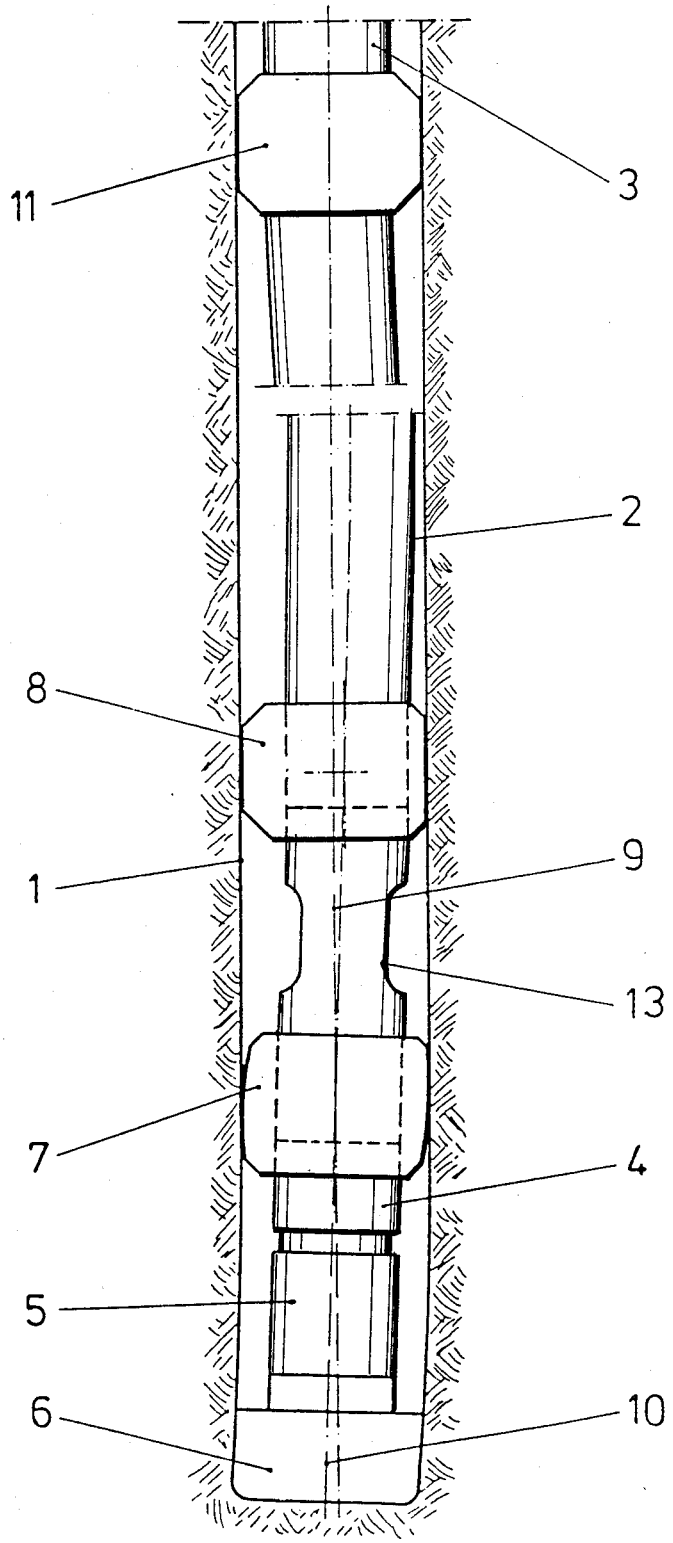

In the embodiment shown in FIG. 3, the second stabiliser 8 is arranged to be closer to the first stabiliser 7. In comparison with the embodiment shown in FIG. 2, this shortens the leverage effecting the deflection of the axis of rotation 10 so that the necessary eccentricity of the second stabiliser 8 can be of smaller magnitude. The arrangement produces an especially high bending load on the housing section located between the first stabiliser 7 and the second stabiliser 8 and this is constructed as a relatively flexible section 13 in order to absorb this bending load.

The second stabiliser 8 is constructed to be interchangeable in order to be free to provide the eccentricity required for the maximum desired radius of curvature of the deflected drilling. In this arrangement, the second stabiliser 8 can be formed with an integral stress relieving section, such as a relatively flexible section, a joint arrangement or a permanently angled connection.

If a displacement-type motor of the Moineau-type is used, a universal-joint in the shaft joining the motor rotor and the take-off shaft 5 supported in the lower housing section 4 is arranged in the flexible section 13. The universal-joint in the shaft may be connected to the motor rotor and/or the take-off shaft 5 by means of a socket coupling so that the drilling tool 27 can be easily assemblied or disassembled when the second stabiliser 8 is exchanged.

Figure 4:
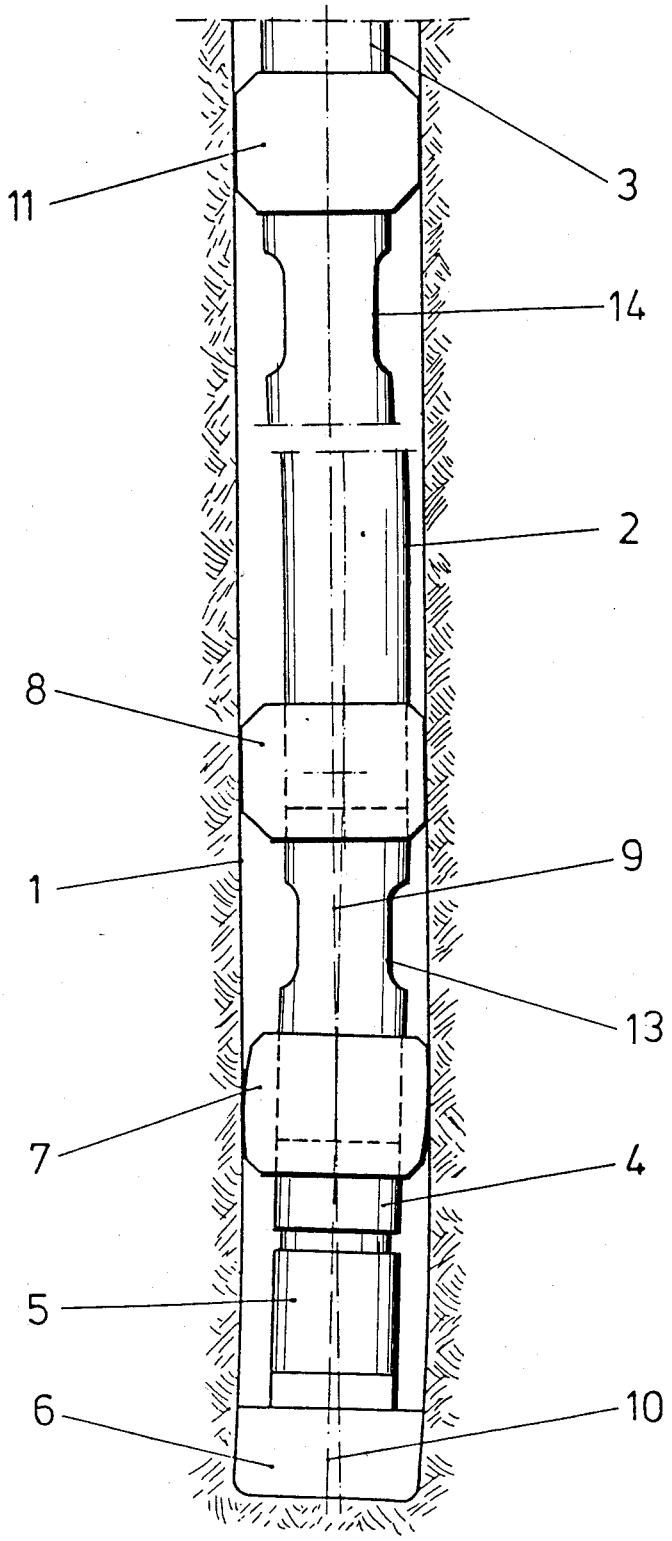

FIG. 4 shows a further development of the embodiment of FIG. 3, in which a further flexible section 14 is arranged above the second stabiliser 8 and the housing 2. This section 14 absorbs the bending load which is opposite to that of the flexible section 13 so that, similarly to the flexible section 12 in FIG. 2, bending loads are kept away from the housing 2 and the drill string 3 above the drilling tool 27.

Figure 5:
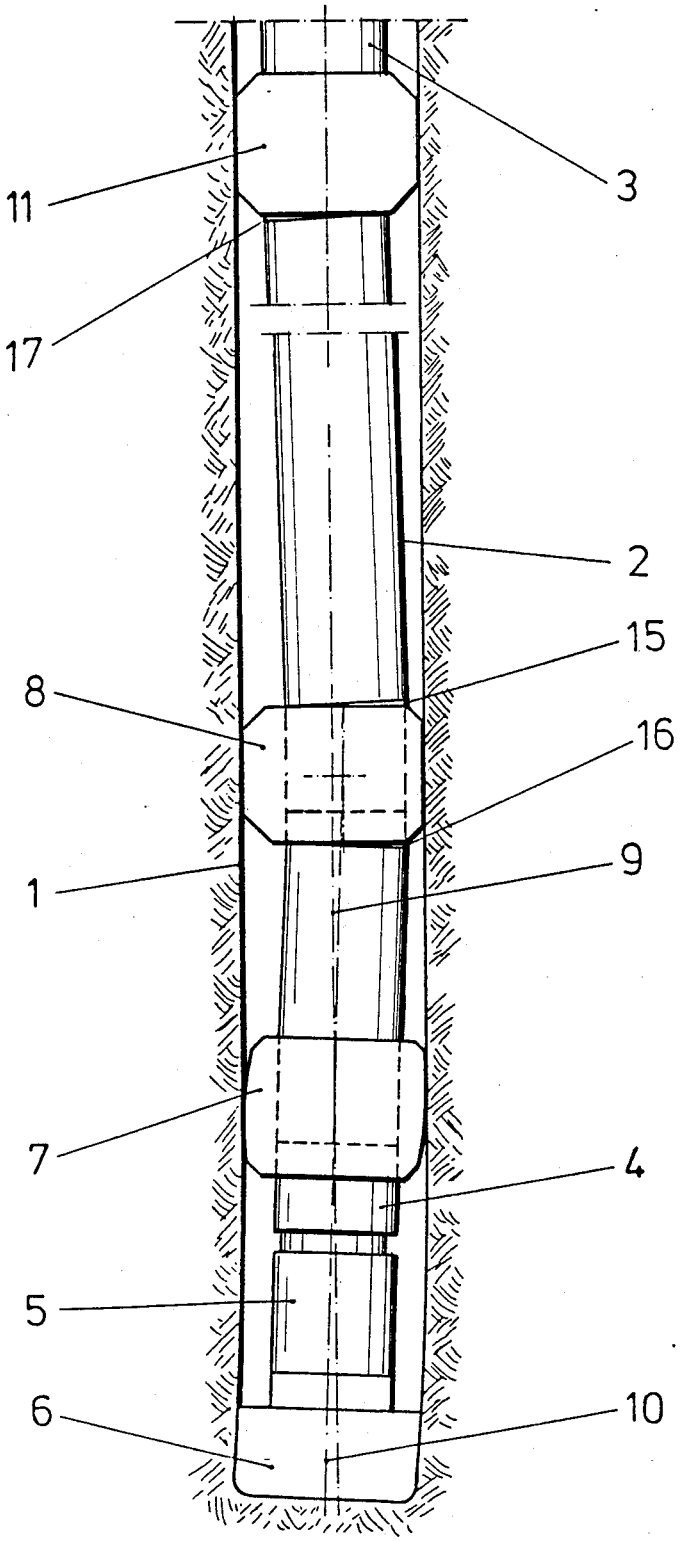

In the alternative of FIG. 5 the arrangement of the stabilisers 7, 8 and 11, the deflection of the housing 2 and the take-off shaft 5 are similar to those in FIG. 4, but instead of the flexible sections 13, 14, the connections 15, 16 of the second stabiliser 8 and the adjoining housing sections and the connection 17 of the third stabiliser 11 are secured, e.g. by welding, at a predetermined angle. This imparts greater rigidity to the drilling device 27 without placing an excessive bending load on individual components.

As is shown by the illustrations discussed above, the drilling device 27 imparts to the bore-hole 1 a course which is in the direction of the axis of rotation 10, the stabiliser 8 and the housing 2 being restrained. When the stabiliser 8 and the housing 2 are also rotated by means of the drill string 3, the angled axis of rotation 10 of the take-off shaft 5 also rotates so that the resultant motion of the rotary drilling bit 6 provides the bore-hole 1 with a course in the direction of the original drill hole axis 9. Thus, selective directional drilling or straight drilling can be achieved in a simple manner by restraining or rotating the second stabiliser 8 by means of the housing 2, the drill string 3 and the turntable 28.

Figure 6:
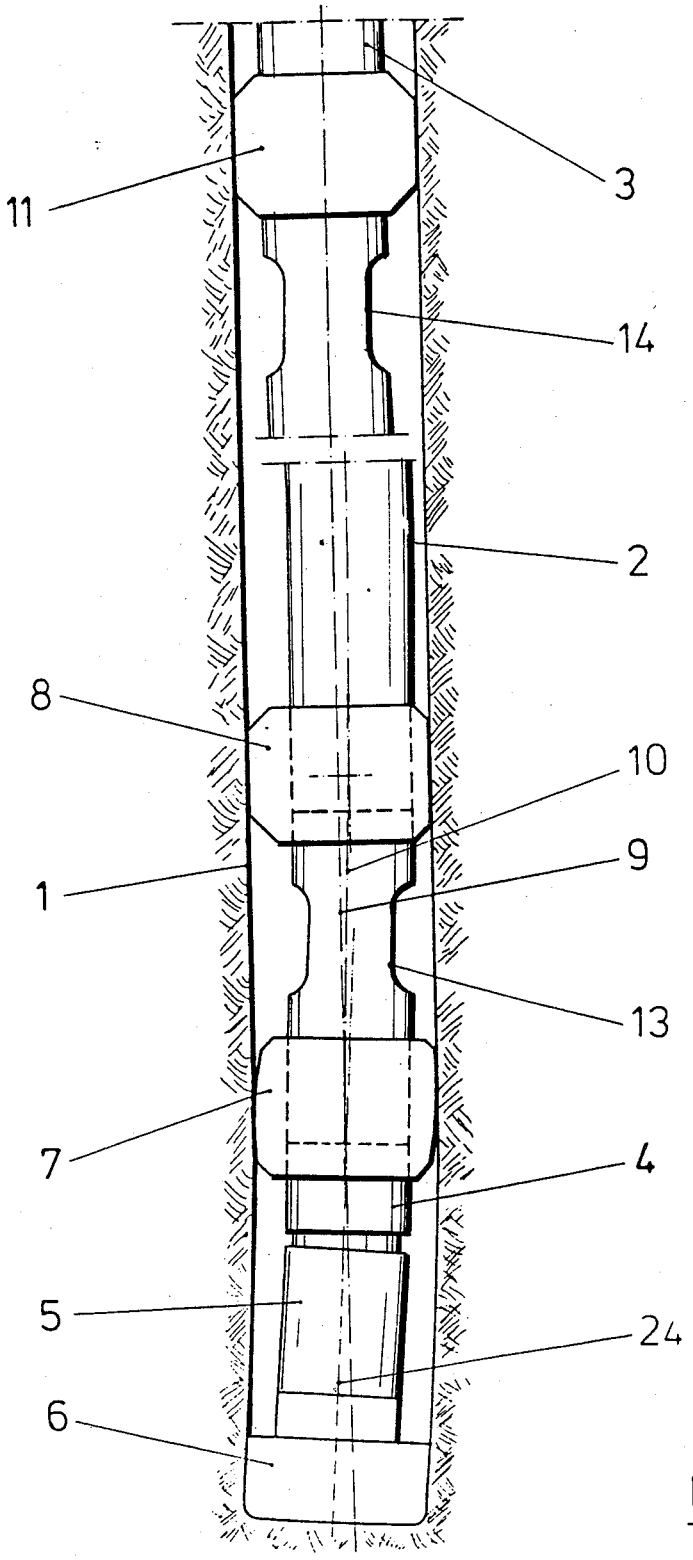
Figure 7:
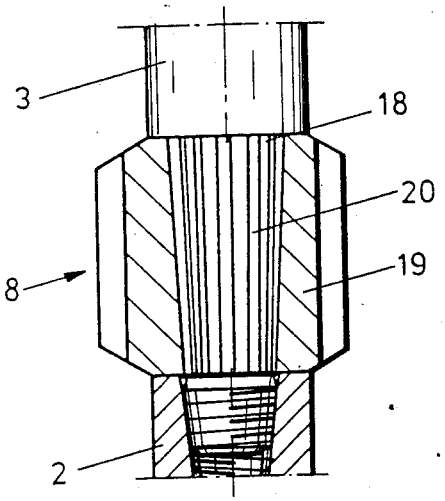
FIGS. 7 to 11 are schematic illustrations of different forms of stabilisers for use in devices according to the present invention.
Figure 8:
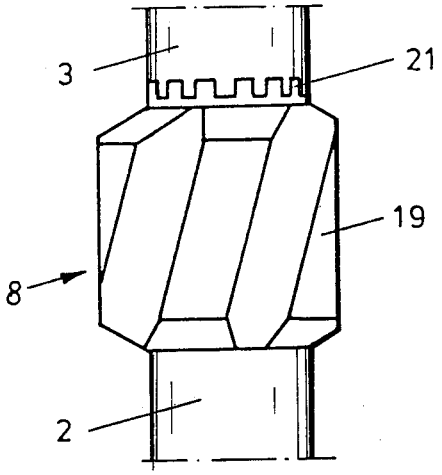

If the diameter of the bore-hole 1 permits only a slight inclination of the housing 2, the take-off shaft 5 can be angled in the housing 2, as shown in FIG. 6, resulting in an axis of rotation 24.

Since the largest reaction forces occur at the surface of the rib projecting furthest from the second eccentric stabiliser 8 the area, of the first concentric stabiliser 7 which is located diagonally opposite, is aligned relative to the second stabiliser 8 in such a manner that this area also carries a rib. To carry out this alignment, it can be advantageous to construct the first and/or second stabiliser to be alignable.

FIGS. 7 to 11 show schematic illustrative embodiments of the construction of various types of stabilisers 8.

In each case the second stabiliser 8 consists of a carrier body 18 and a shell 19 having a peripheral rib or ribs which can be fixed on the carrier body 18 by a connection having complementary formations such as splines or teeth. In the embodiments shown in FIGS. 7 and 8, the ribbed sleeve 19 can be aligned stepwise relative to the carrier body 18. The connection between the parts 18 and 19 is formed in the embodiment in FIG. 7 by a interlocking spline arrangement and in FIG. 8 by radially distributed teeth 21.

Figure 9:
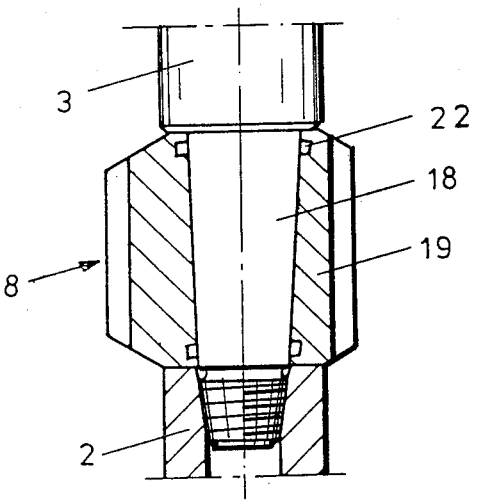
Figure 10:
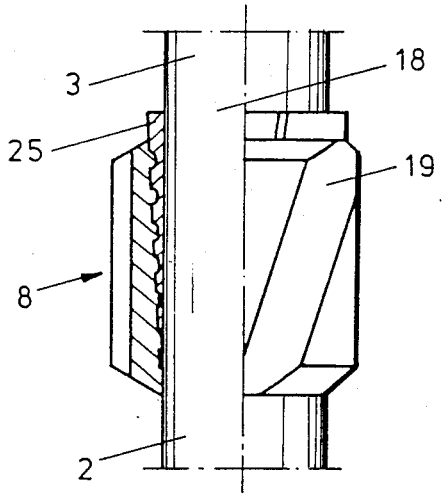
Figure 11:
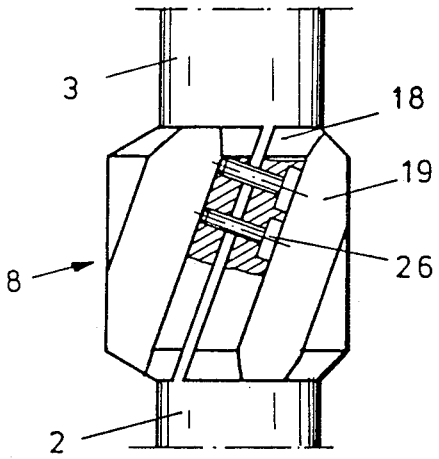

The alternative embodiments shown in FIGS. 9 to 11 make it possible to provide continuous adjustment of the ribbed shell 19 with respect to the carrier body 18 and to fix it by means of a frictional connection. In FIG. 9, the necessary friction is produced by applying hydraulic pressure to expand the ribbed shell 19, forcing it onto the carrier body. The shell is provided with seals 22 to restrain the hydraulic fluid.

FIG. 10 shows an alternative fixing arrangement using a longitudinally slotted intermediate shell 25 which offers a conical threaded area to the ribbed shell 19 and, when screwed together with the shell 19, locks it to the carrier body 18. In the alternative shown in FIG. 11 the ribbed shell 19 is slotted along a rib and is clamped to the carrier body 18 by several screws 26.

Figure 12:
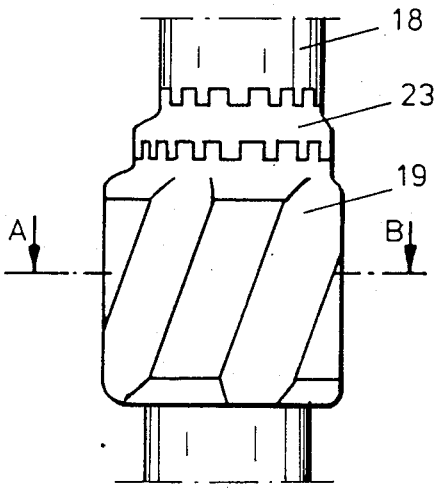
FIG. 12 is a schematic side view of a stabiliser having variable eccentricity.
Figure 13:
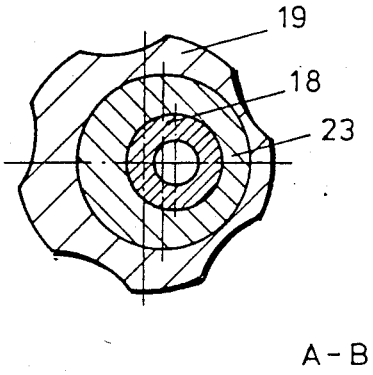
FIG. 13 is a cross-section on the line A-B of FIG. 12.

The embodiment shown in FIGS. 12 and 13 is provided with an eccentric intermediate shell 23, in addition to the carrier body 18 and the ribbed shell 19. By relative rotation of the ribbed shell 19 and the intermediate shell 23, the amount of eccentricity of the stabiliser 8 can thus be altered in steps between a maximum value and a minimum value, retaining the possibility of alignment with respect to the carrier body 18. The parts are fixed by radially distributed teeth as described with respect to the embodiment of FIG. 8.

If the eccentricity of the second eccentric stabiliser 8 is to be adapted to deflected drilling with respect to certain bore-hole conditions and radii of curvature, the second stabiliser 8 can also be constructed to be adjustable in a manner as described above. In addition the concentric stabiliser or stabilisers can also be constructed to be alignable in a similar manner as described above in relation to the eccentric stabilisers.

In order to optimise the straight drilling characteristics of a drilling tool equipped with the features according to the invention, even with inclined bore-holes, the first concentric stabiliser 7 is preferably of the size equal to the diameter of the bore-hole whilst the second eccentric stabiliser 8 has smaller dimensions in order to compensate for the tendency to change inclination resulting from the bending of the housing 2 and of the take-off shaft 5.

We claim:

1. A device for use in underground drilling comprising:

a tubular housing, comprised of a plurality of connected sections of substantially the same diameter, a down-hole motor mounted within the housing and having an output shaft rotatably supported in a lower section of the housing, means for connecting said output shaft to a drill bit, means for connecting an upper end of said housing to a drill string, first and second stabilisers mounted adjacent to and spaced from each other on said housing, said first stabiliser being mounted on a lower section of the housing and nearer than the second stabiliser to the output shaft connecting means, and at least one stress relieving means provided on said housing above the first stabiliser and below the means for connecting the upper end of said housing to the drill string;

each of said stress relieving means comprising a relatively flexible section of said housing adapted to bend and permit during drilling an angular relationship and connection between adjacent sections of the housing, and said first stabiliser being concentric with the housing and said second stabiliser being eccentric with the housing.

2. A device according to claim 1 in which the stress relieving means is situate between the second stbiliser and the drill string connecting means.

3. A device according to claim 1 including at least two stress relieving means, comprising a first stress relieving means being situate between the concentric and eccentric stabilisers and a second stress relieving means being situate between the eccentric stabiliser and the drill string connecting means.

4. A device according to claim 3 comprising a further third concentric stabiliser situate above the second eccentric stabiliser and in which a third stress relieving means is situate above the second eccentric stabiliser.

5. A device according to claim 1 which further comprises an angular connection of at least one stabiliser between and connecting adjacent sections of said housing together at an angle.

6. A device according to claim 1 in which at least one stabiliser is provided with at least one radially extending rib.

* * * * *